US006378254B1

(12) United States Patent
Gould

(10) Patent No.: US 6,378,254 B1
(45) Date of Patent: Apr. 30, 2002

(54) NON-LEAKING WINDOW FRAME STRUCTURE

(75) Inventor: Charles H. Gould, North Vancouver (CA)

(73) Assignee: Morzen Artistic Aluminum Ltd., Langley (CA)

( * ) Notice: Subject to any disclaimer, the term of this patent is extended or adjusted under 35 U.S.C. 154(b) by 0 days.

(21) Appl. No.: 09/591,491

(22) Filed: Jun. 12, 2000

(51) Int. Cl.[7] ..... E06B 3/964

(52) U.S. Cl. ..... 52/204.63; 52/204.52; 52/204.597; 52/204.7; 52/204.72

(58) Field of Search ..... 52/204.1, 204.52, 52/302.7, 204.72, 204.597, 202.1, 204.63, 204.62, 204.7

(56) References Cited

U.S. PATENT DOCUMENTS

| | | | | | |
|---|---|---|---|---|---|
| 2,886,864 | A | | 5/1959 | Boicey et al. | |
| 2,887,737 | A | | 5/1959 | Prescott | |
| 3,851,794 | A | | 12/1974 | Hebl | |
| 4,290,536 | A | | 9/1981 | Morel | |
| 4,588,105 | A | | 5/1986 | Schmitz et al. | |
| 5,230,180 | A | * | 7/1993 | Tweedt et al. | 49/400 |
| 5,345,734 | A | | 9/1994 | Tremblay | |
| 5,379,560 | A | * | 1/1995 | Steller | 52/204.7 |
| 5,505,324 | A | | 4/1996 | Danico | |
| 6,006,478 | A | * | 12/1999 | Hubner et al. | 52/204.5 |
| 6,055,783 | A | * | 5/2000 | Guhl et al. | 52/204.62 |
| 6,167,662 | B1 | * | 1/2001 | Gruber | 52/204.1 |

* cited by examiner

*Primary Examiner*—Carl D. Friedman
*Assistant Examiner*—Yvonne M. Horton
(74) *Attorney, Agent, or Firm*—C. A. Rowley

(57) ABSTRACT

A window frame structure formed from hollow members is formed with access holes through the outer walls through which fasteners are inserted and tightened to bear against an inner wall of the member (opposite the outer wall) and then the access hole is sealed with a sealing plug to prevent moisture from passing through fastener holes in the outer walls and into the supporting wall.

4 Claims, 2 Drawing Sheets

PRIOR ART

NON-LEAKING WINDOW FRAME STRUCTURE

FIELD OF INVENTION

The present invention relates to widow frame structure with improved seal.

BACKGROUND OF THE INVENTION

In the assembly of aluminum or vinyl frame windows the frames are constructed of individual parts (usually extrusions) that are cut to size, assembled and the parts secured together by screws. Normally the extrusions are hollow and the screws pass from the outside or exposed side of the frame through the hollow and into and through the extrusion wall opposite the outside wall on one part and then into the other frame part that is to be secured to the one part (see FIG. 1). This structure while relatively simple and easy to fabricate leaves a leaky passage formed by the fastener (screw) receiving hole that passes through the outer wall of the one part. This structure has created problems in the industry for many years because of this leakage since when the leaky hole overlies the inside of the wall any fluid (water) leaking there from passes into and may over time damage the wall structure, but no satisfactory commercial solution had been found (prior to the present invention). Certainly drainage holes are provided through the frame for draining water from the inside of the hollow frame and directing it outside the wall structure, nevertheless water still finds its way to and through the fastener hole through the bottom outside wall of the frame.

The use of plugs to seal holes in structures has been known for many years, examples of such plugs are shown in for example U.S. Pat. No. 2,886,864 issued May 19, 1959 to Boicey et al.; U.S. Pat. No. 2,887,737 issued May 26, 1959 to Prescott; U.S. Pat. No. 3,851,794 issued Dec. 3, 1974 to Hehl; U.S. Pat. No. 4,290,536 issued Sep. 22, 1981 to Morel; U.S. Pat. No. 4,588,105 issued May 13, 1986 to Schmitz et al.; U.S. Pat. No. 5,345,734 issued Sep. 13, 1994 to Tremblay; and/or U.S. Pat. No. 5,505,324 issued Apr. 9, 1996 to Danico. U.S. Pat. Nos. 2,886,864, 2,887,737 and 5,345,734 are specifically related to windows and provide plugs for sealing glazing for example in double glazed windows.

BRIEF DESCRIPTION OF THE PRESENT INVENTION

It is an object of the present invention to provide a window frame structure wherein water drainage into the supporting wall may be substantially eliminated.

Broadly the present invention relates to a window frame structure form from a plurality of discrete elements at least some of which are hollow elements having an outer wall and an inner wall on the opposite side of hollow in said hollow element from said outer wall, the improvement comprising a hole through said outer wall of one of said hollow elements, a fastener, said fastener positioned opposite said hole and passing through said inner wall and into a second of said discrete elements to secure said one of said hollow elements to said second discrete element and a sealing plug secured in sealing relationship to said hole to prevent water from passing from inside said hollow through said hole.

Preferably said plug is welded into said hole.

Preferably said widow frame is mounted in a wall structure and where said plug is position on a bottom of said frame over an inside portion of said wall structure.

BRIEF DESCRIPTION OF THE SEVERAL VIEWS OF THE DRAWING(S)

Further features, objects and advantages will be evident from the following detailed description of the preferred embodiments of the present invention taken in conjunction with the accompanying drawings in which.

DETAILED DESCRIPTION OF THE INVENTION

Figure 1:
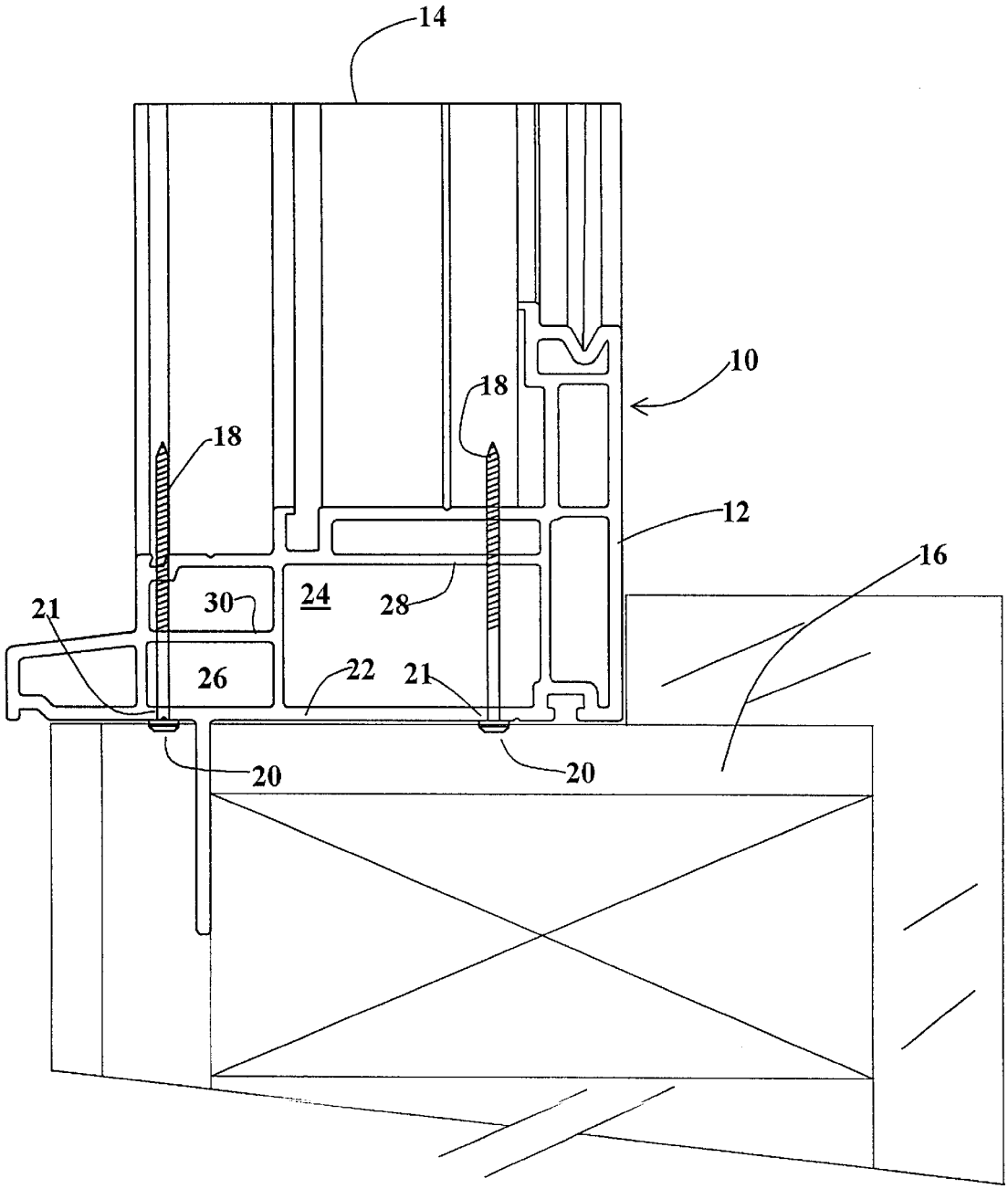
FIG. 1 is a section through an assembled window frame constructed in accordance with the prior art.

Turning first to FIG. 1 which illustrates the conventional manner of constructing or assembling widow and/or window frames 10 from discrete elements (generally formed by extrusion from vinyl or aluminum) only two shown, namely a first element in the form of a hollow horizontal element (window sill element) 12 and a second element in the form of a vertical frame element 14. The window is supported in the conventional manner on a wall 16. The frame elements 12 and 14 are secured together by fasteners two of which are shown at 18. Threaded screw fasteners 18 are normally used to secure the frame elements (12 and 14) together. The window or frame 10 as shown in FIG. 1 the screw fasteners 18 pass through holes 21 in the outer (lower) wall 22 and through the hollow 24 or 26 of the element 12 and then through the inner walls 26 and 28 of the element 12 opposite the hole 21 in the outer wall 22 and then into the second element 14. Each fastener 18 has a head 20 that is forced against an outer wall 22 of the element 12 to tightly bind the two elements 12 and 14 together.

It will be noted that the screw 18 and thus the holes 21 directly overlie the inside of the house or structural wall 16 so that any liquid passing from inside the hollows 24 or 26 drip into the interior of the wall structure 16 and may cause damage. The pressure of the heads 20 against the outside of the wall 22 tends to provide a seal, but leakage has still been found.

Figure 2:
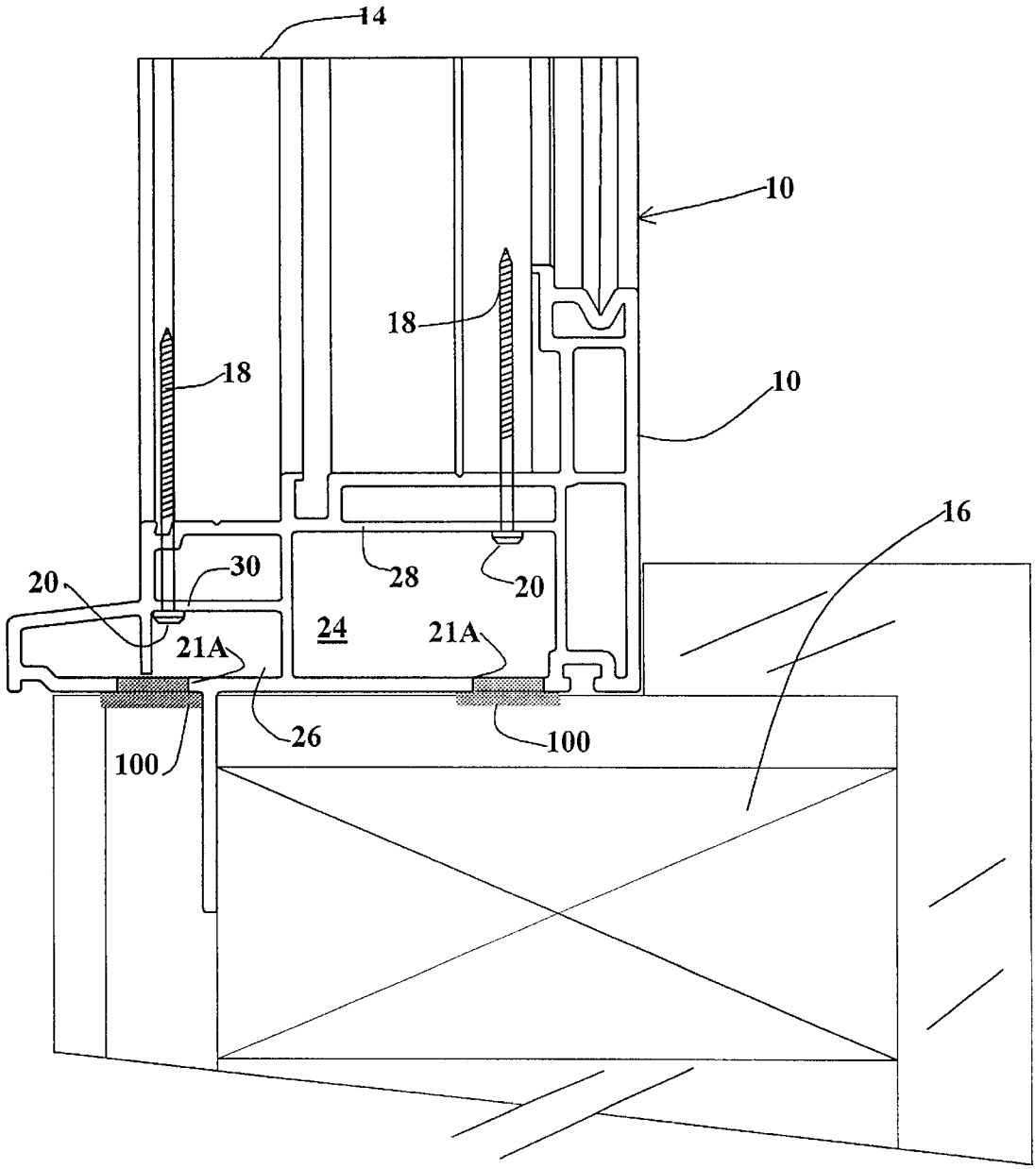
FIG. 2 is a section through an assembled window frame constructed in accordance with the present invention.

Turning to FIG. 2 and the present invention, like part in FIGS. 1 and 2 have the same reference numerals so only the differences in the structures will be describe. In the present invention (FIG. 2) the holes 21 have been replaced by significantly larger holes 21A that are sufficiently large so as to permit the head 20 of the fastener 18 to pass there through. Thus in the structure of FIG. 2 the heads of the fasteners are positioned within the hollows 24 and 26 and bear directly against the inner walls 28 and 30 of the hollow element 12. Positioning the heads closer to the element 14 being secured to the element 12 improves the effectiveness of the fastener(s) 18. The holes 21 A provide access to the heads 20 for assembly.

When the frame 10 has been assembled the sealing plugs 100 are positioned in their respective holes 21A and are secured therein by any suitable means. For example the plugs may be welded in position sealing their respective hole 21A by solvent welding or vibration welding (depending on the material of the plugs 100 and the frame member 12) or the like.

The plugs have been found to be effective to stop movement of water into or out of the hollows 24 and 26 in the member 12, so that the hole 21 A positioned over the inside of the wall 16 do not permit water to pass from the hollows 24 and 26 into the interior of the structural wall 16. Furthermore moving the heads 20 and shafts of the screws 18 to be positioned against the wall 28 or 30 as opposed to the bottom wall 22 ensures that the screws 18 (and heads 20) do not pass through or rest in pool water that may accumulate on the bottom wall such as wall 22.

Having described the invention, modifications will be evident to those skilled in the art without departing from the scope of the invention as defined in the appended claims.

I claim:

1. A window frame structure comprising a plurality of separate frame forming elements at least some of which are hollow elements each having a hollow central portion and an outer wall and an inner wall on the opposite side of said hollow portion in said hollow element from said outer wall, the improvement comprising a hole through said outer wall of one of said hollow elements, a mechanical fastener element having a head, said fastener element passing through said inner wall and into a second of said plurality of separate elements to secure said one of said hollow elements to said second of said plurality of separate elements said head positioned within said hollow central portion of said one of said hollow elements and in pressing relationship against said inner wall, said hole being opposite said fastener element in a position to permit said fastener element to pass through said hole and to provide access to said head during assembly of said frame and a sealing plug secured in sealing relationship to said hole to prevent water from passing through said hole when said frame has been assembled.

2. A window frame structure as defined in claim 1 wherein said plug is welded into said hole.

3. A window frame structure as defined in claim 1 further comprising a wall structure said widow frame mounted in said wall structure and where said plug is positioned on a bottom of said frame over an inside portion of said wall structure.

4. A window frame structure as defined in claim 2 further comprising a wall structure said window frame mounted in said wall structure and where said plug is positioned on a bottom of said frame over an inside portion of said wall structure.

* * * * *